US011304534B1

(12) United States Patent
Carreon

(10) Patent No.: US 11,304,534 B1
(45) Date of Patent: Apr. 19, 2022

(54) BED COOLING ASSEMBLY

(71) Applicant: Daniel Carreon, Plainfield, IL (US)

(72) Inventor: Daniel Carreon, Plainfield, IL (US)

( * ) Notice: Subject to any disclaimer, the term of this patent is extended or adjusted under 35 U.S.C. 154(b) by 0 days.

(21) Appl. No.: 17/072,156

(22) Filed: Oct. 16, 2020

(51) Int. Cl.
*A47C 21/04* (2006.01)
*A47C 31/00* (2006.01)

(52) U.S. Cl.
CPC ..... *A47C 21/044* (2013.01); *A47C 31/008* (2013.01)

(58) Field of Classification Search
CPC ..... A47C 21/044; A47C 21/048; A47C 21/04; A47C 31/008; F16L 3/13; F16L 3/003
See application file for complete search history.

(56) References Cited

U.S. PATENT DOCUMENTS

| | | | | |
|---|---|---|---|---|
| 2,235,966 A | | 3/1941 | Summers | |
| 3,230,556 A | * | 1/1966 | Shippee | A47C 21/044 5/423 |
| 3,370,815 A | * | 2/1968 | Opperthauser | F16L 3/13 248/74.2 |
| 6,363,551 B1 | | 4/2002 | Flores | |
| 7,613,377 B2 | * | 11/2009 | Gonzales | G02B 6/4471 385/134 |
| 7,631,377 B1 | | 12/2009 | Sanford | |
| 7,913,332 B1 | | 3/2011 | Barnhart | |
| D686,723 S | | 7/2013 | Gulau | |
| 9,192,244 B2 | * | 11/2015 | Rand | A47C 21/044 |
| 10,660,451 B2 | | 5/2020 | Aramili | |
| 2015/0233592 A1 | * | 8/2015 | Giraud | F24F 5/0042 62/3.7 |
| 2017/0196367 A1 | * | 7/2017 | Aramli | A47C 21/044 |
| 2018/0027981 A1 | * | 2/2018 | Sherman | A47C 27/18 |
| 2019/0059603 A1 | | 2/2019 | Griffith | |
| 2019/0223614 A1 | * | 7/2019 | Aramli | A47C 31/008 |

FOREIGN PATENT DOCUMENTS

| | | |
|---|---|---|
| WO | WO03037141 | 5/2003 |

* cited by examiner

*Primary Examiner* — Robert G Santos
*Assistant Examiner* — Alison N Labarge

(57) ABSTRACT

A bed cooling assembly includes a blower unit that is positionable adjacent to a bed for sleeping. A pair of hoses is each of the hoses is fluidly coupled to the blower unit to direct the air blown by the blower unit. A pair of restraints is each removably attachable to a respective one of the hoses to mount the respective hose to the sleeping bed. A pair of exhaust vents is each fluidly coupled to a respective one of the hoses to receive the air from the blower unit. Each of the exhaust vents is positionable between the sleeping bed and a blanket on the sleeping bed to direct the air onto a user sleeping on the sleeping bed thereby cooling the user.

16 Claims, 7 Drawing Sheets

BED COOLING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to cooling devices and more particularly pertains to a new cooling device for cooling a user sleeping in a bed.

(2) Description of Related Art Including Information Disclosed Under 37 CFR 1.97 and 1.98

The prior art relates to cooling devices including a blower that has an exhaust port that blows air into a mattress for cooling the mattress. The prior art discloses a variety of blowers that includes a pair of hoses a pair of exhaust vents for blowing air between a blanket and a mattress on bed.

BRIEF SUMMARY OF THE INVENTION

An embodiment of the disclosure meets the needs presented above by generally comprising a blower unit that is positionable adjacent to a bed for sleeping. A pair of hoses is each of the hoses is fluidly coupled to the blower unit to direct the air blown by the blower unit. A pair of restraints is each removably attachable to a respective one of the hoses to mount the respective hose to the sleeping bed. A pair of exhaust vents is each fluidly coupled to a respective one of the hoses to receive the air from the blower unit. Each of the exhaust vents is positionable between the sleeping bed and a blanket on the sleeping bed to direct the air onto a user sleeping on the sleeping bed thereby cooling the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
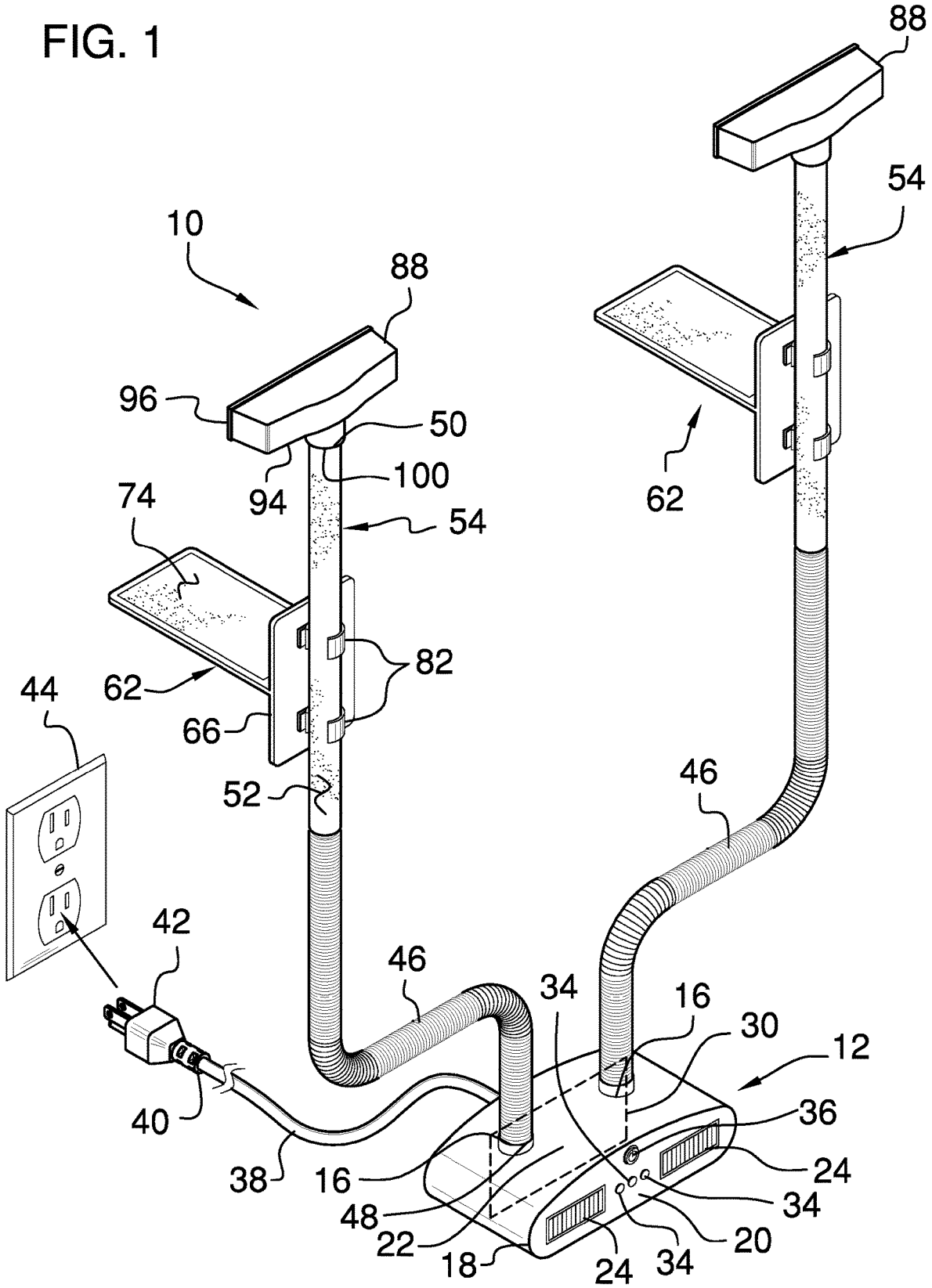
FIG. 1 is a perspective view of a bed cooling assembly according to an embodiment of the disclosure.
Figure 2:
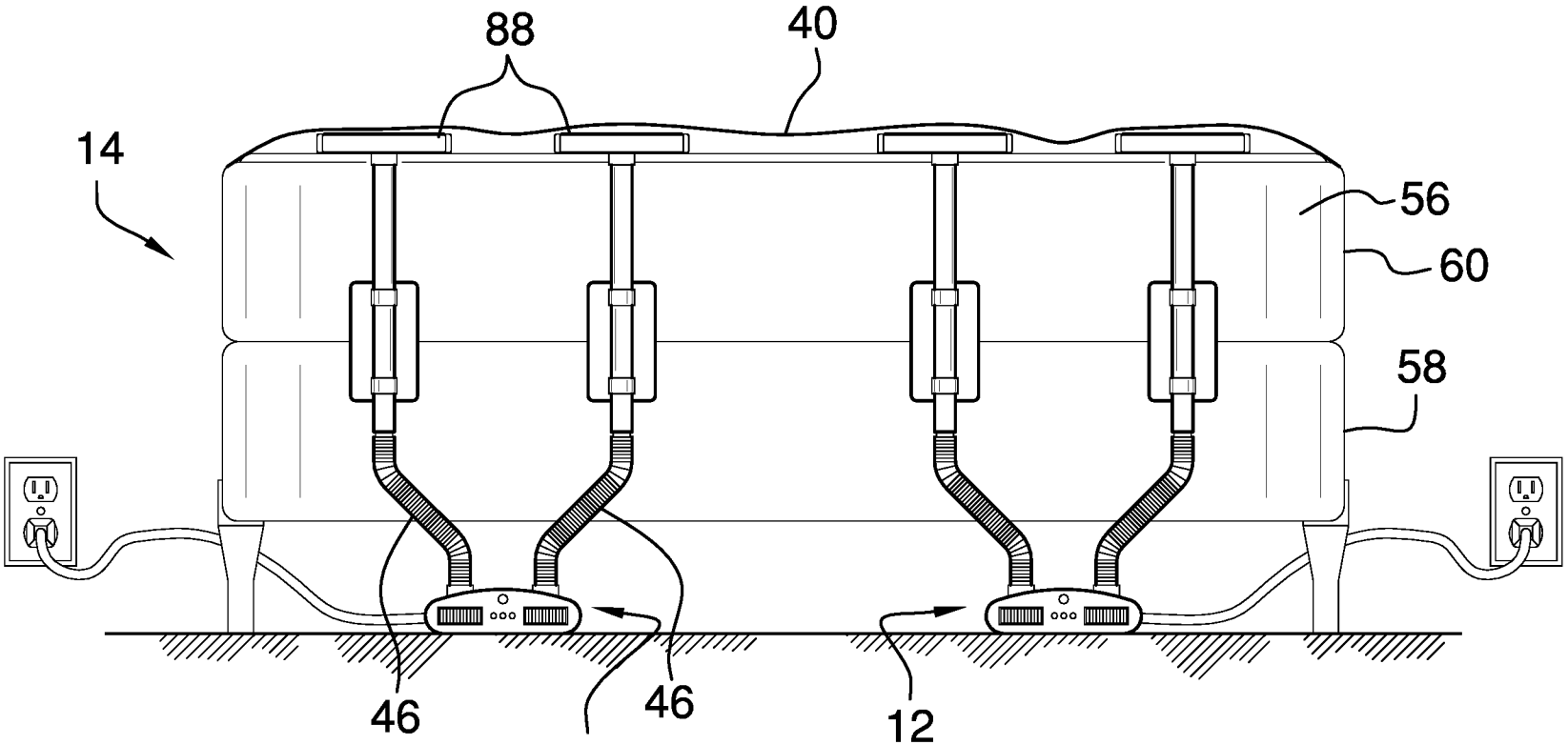
FIG. 2 is a front in-use view of an embodiment of the disclosure.
Figure 3:
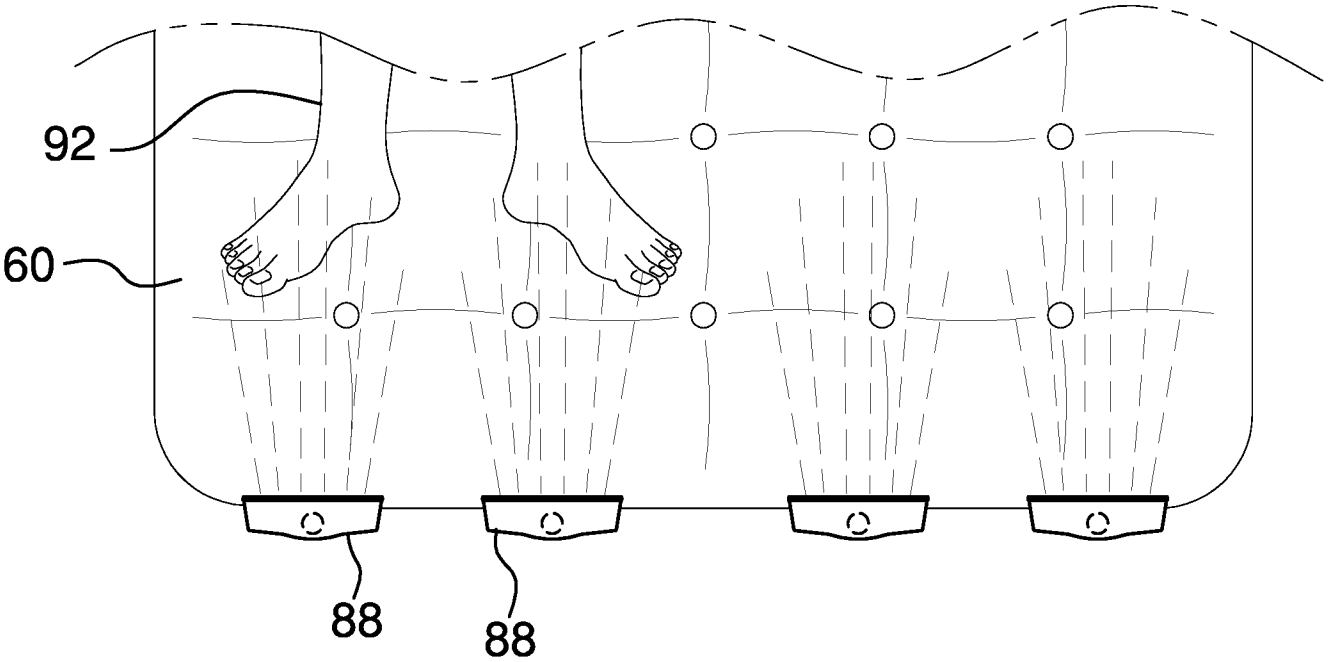
FIG. 3 is a top in-use view of an embodiment of the disclosure.
Figure 5:
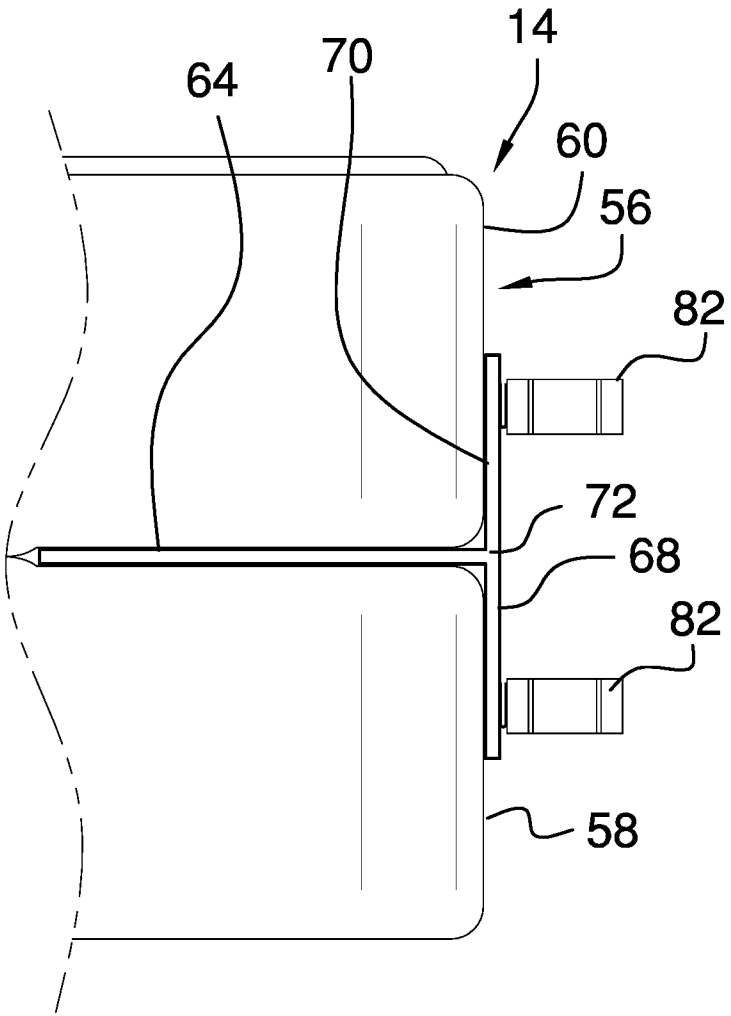
FIG. 5 is a perspective in-use view of a restraint of an embodiment of the disclosure.
Figure 4:
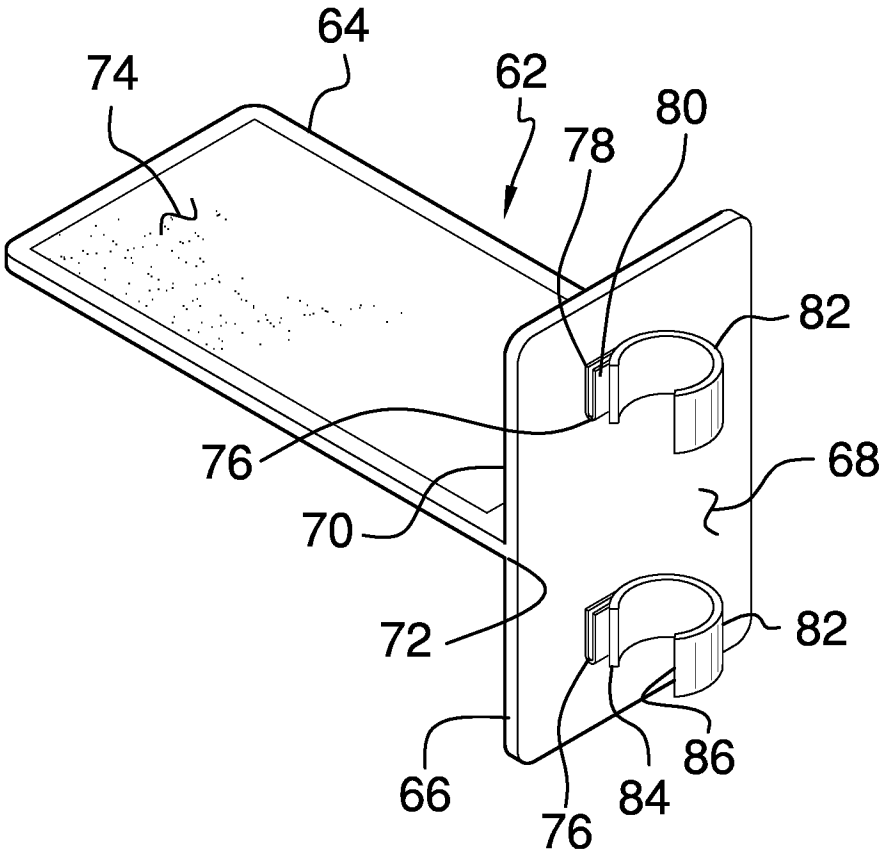
FIG. 4 is a perspective view of a restraint of an embodiment of the disclosure.
Figure 7:
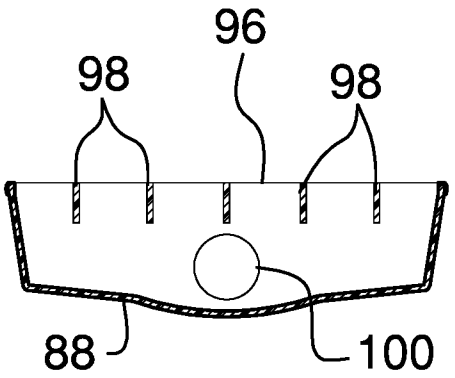
FIG. 7 is a cross sectional view taken along line 7-7 of FIG. 6 of an embodiment of the disclosure.
Figure 6:
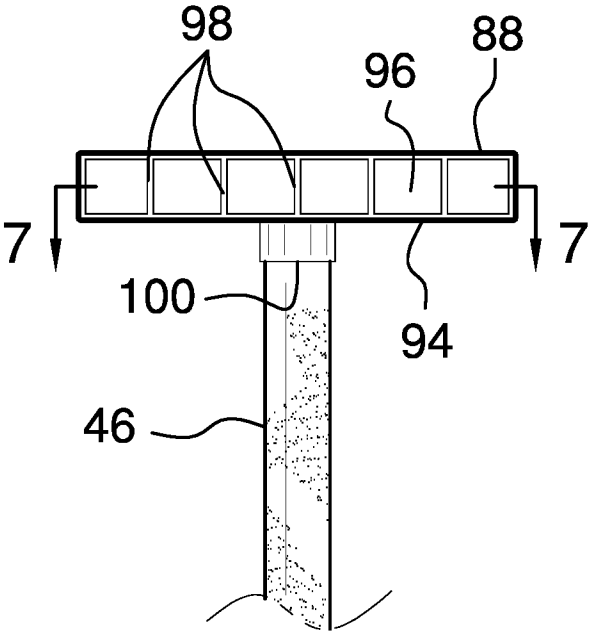
FIG. 6 is a front view of an exhaust vent of an embodiment of the disclosure.
Figure 8:
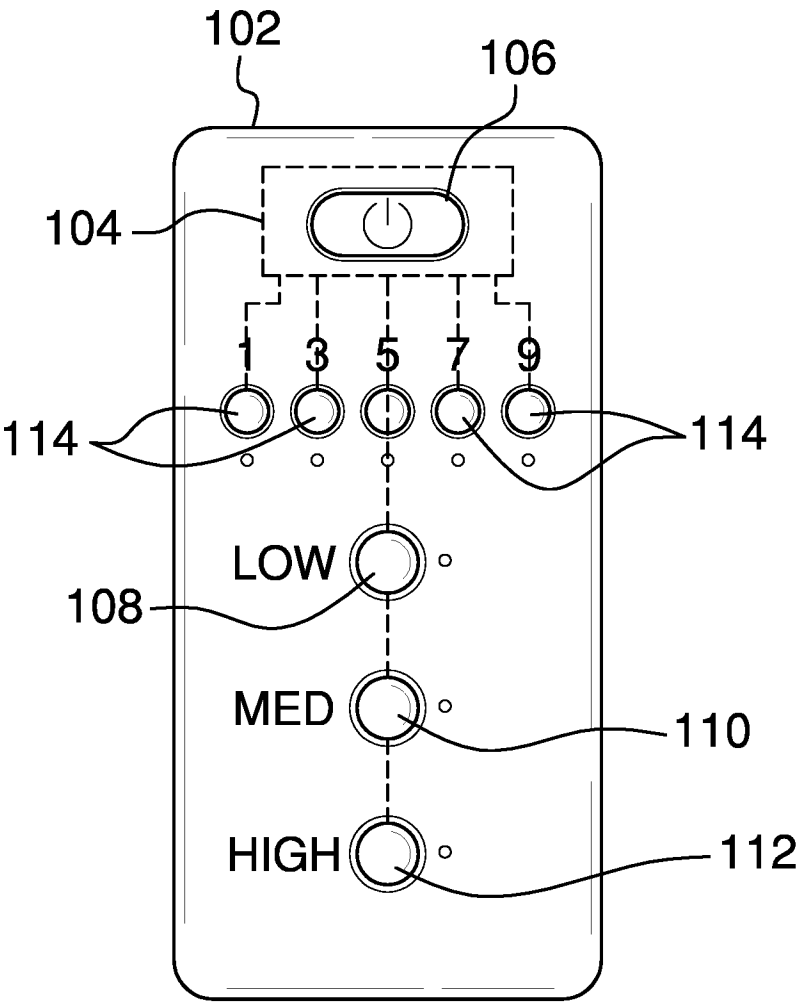
FIG. 8 is a perspective view of remote control of an embodiment of the disclosure.
Figure 9:
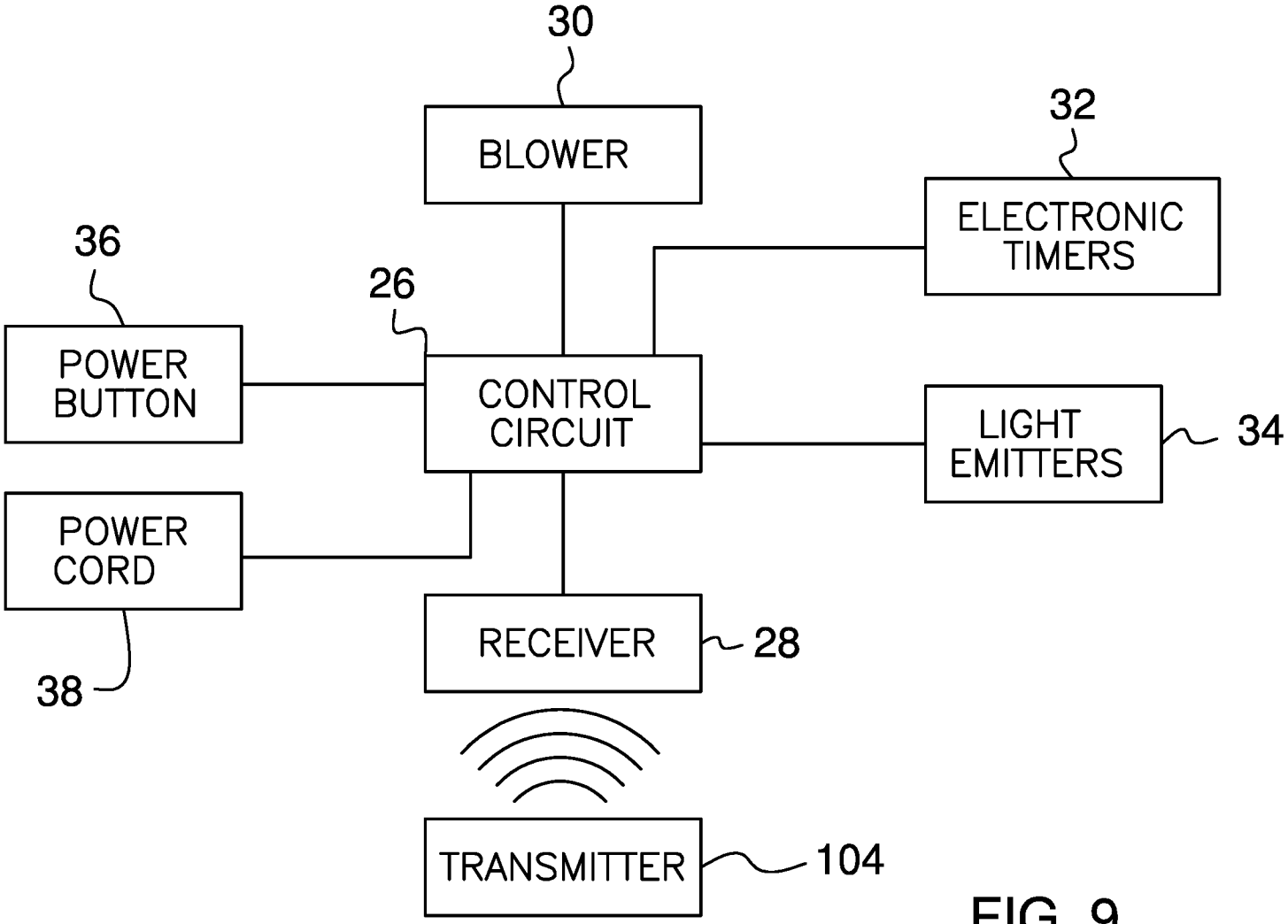
FIG. 9 is a schematic view of an embodiment of the disclosure.

With reference now to the drawings, and in particular to FIGS. 1 through 9 thereof, a new cooling device embodying the principles and concepts of an embodiment of the disclosure and generally designated by the reference numeral 10 will be described.

As best illustrated in FIGS. 1 through 9, the bed cooling assembly 10 generally comprises a blower unit 12 that can be positioned adjacent to a sleeping bed 14. The blower unit 12 has a pair of outputs 16 for blowing air outwardly through the outputs 16 when the blower unit 12 is turned on. The blower unit 12 comprises a housing 18 that has a front wall 20 and a top wall 22, and each of the outputs 16 extends through the top wall 22. The front wall 20 has a pair of intakes 24 that each extends into an interior of the housing 18 to pass air into the housing 18.

The blower unit 12 includes a control circuit 26 that is positioned in the housing 18. The control circuit 26 receives an on input, an off input, a low input, a medium input and a maximum input. The blower unit 12 includes a receiver 28 that is positioned in the housing 18 and the receiver 28 is electrically coupled to the control circuit 26. The receiver 28 may comprise a radio frequency receiver or the like.

The blower unit 12 includes a blower 30 that is positioned within the housing 18. The blower 30 is in fluid communication between each of the intakes 24 and each of the outlets. In this way the blower 30 can urge air inwardly through each of the intakes 24 and outwardly through each of the outlets when the blower 30 is turned on. The blower 30 is electrically coupled to the control circuit 26.

The blower 30 is turned on when the control circuit 26 receives the on input and the blower 30 is turned off when the blower 30 receives the off input. The blower 30 is actuated to a minimum speed when the control circuit 26 receives the low input to blow a minimum volume of air. The blower 30 is actuated to a medium speed when the control circuit 26 receives the medium input to blow a medium volume of air. Additionally, the blower 30 is actuated to a maximum speed when the control circuit 26 receives the maximum input to blow a maximum volume of air. The blower 30 may comprise an electric blower that may include an electric motor and a fan that is rotatably coupled to the electric motor.

The blower unit 12 includes an electronic timer 32 that is positioned within the housing 18 and the electronic timer 32 is electrically coupled to the control circuit 26. The electronic timer 32 counts down a duration of time that ranges between a minimum duration of time and a maximum duration of time. Moreover, the control circuit 26 receives the off input when the electronic timer 32 finishes counting time the duration of time. The blower unit 12 includes a plurality of light emitters 34 that is each coupled to the front wall 20 of the housing 18 to emit light outwardly therefrom. Each of the light emitters 34 is electrically coupled to the control circuit 26 and a respective one of the light emitters 34 is actuated when the control circuit 26 receives the low input, the medium input or the maximum input. Additionally, each of the light emitters 34 may comprise an LED or the like.

The blower unit 12 includes a power button 36 that is movably coupled to the front wall 20 of the housing 18 and the power button 36 is electrically coupled to the control circuit 26 for turning the control circuit 26 on and off. The blower unit 12 includes a power cord 38 that is coupled to and extends away from the housing 18. The power cord 38 is electrically coupled to the control circuit 26 and the power cord 38 has a distal end 40 with respect to the housing 18. Additionally, a male plug 42 is electrically coupled to the distal end 40 and the male plug 42 can be plugged into a power source 44 comprising a female electrical outlet.

The blower unit 12 includes a pair of hoses 46 that is each fluidly coupled to a respective one of the outputs 16 on the blower unit 12 to direct the air blown by the blower 30. Each of the hoses 46 has a first end 48, a second end 50 and an outer surface 52 extending therebetween, and the first end 48 of each of the hoses 46 is fluidly coupled to outlets on the top wall 22 of the housing 18. The outer surface 52 of each of the hoses 46 has a rigid portion 54 extending from the second end 50 toward the first end 48 and the rigid portion 54 is comprised of a rigid material thereby inhibiting the rigid portion 54 from flexing. In this way the rigid portion 54 can extend upwardly along a front end 56 of a box spring 58 and a mattress 60 of the sleeping bed 14. Additionally, the rigid portion 54 is textured.

A pair of restraints 62 is provided and each of the restraints 62 is removably attachable to a respective one of the hoses 46. Each of the restraints 62 includes a first panel 64 that is oriented to lay on a horizontal plane. In this way the first panel 64 of each of the restraints 62 can be inserted between the box spring 58 and the mattress 60 of the sleeping bed 14 for mounting the respective hose 46 to the sleeping bed 14. Each of the restraints 62 comprises a second panel 66 that has a first surface 68 and a second surface 70. A perimeter edge 72 of the first panel 64 is coupled to the second surface 70 such that the first panel 64 lies on a plane that is oriented perpendicular to the second surface 70. The first panel 64 has a top surface 74 and the top surface 74 of the first panel 64 is textured to frictionally engage the mattress 60 thereby retaining the first panel 64 between the mattress 60 and the box spring 58.

Each of the restraints 62 includes a pair of shock absorbers 76 and each of the shock absorbers 76 has a first portion 78 that is spaced from a second portion 80. The second portion 80 of a respective shock absorber 76 is biased away from the first portion 78 of the respective shock absorber 76. Additionally, the second portion 80 of a respective shock absorber 76 is compressible toward the first portion 78 of the respective shock absorber 76. The first portion 78 of each of the shock absorbers 76 is coupled to the first surface 68 of the second panel 66. The shock absorbers 76 are spaced apart from each other and are distributed along the second panel 66.

Each of the restraints 62 includes a pair of clamps 82 and each of the clamps 82 is coupled to the second portion 80 of a respective one of the shock absorbers 76. Each of the clamps 82 has a primary end 84 and a secondary end 86, and each of the clamps 82 is curved between the primary end 84 and the secondary end 86 such that each of the clamps 82 has a C-shape. In this way each of the clamps 82 can releasably engage the rigid portion 54 of a respective one of the hoses 46 thereby attaching the respective hose 46 to the second panel 66.

A pair of exhaust vents 88 is provided and each of the exhaust vents 88 is fluidly coupled to a respective one of the hoses 46 to receive the air from the blower unit 12. Each of the exhaust vents 88 is positionable between the sleeping bed 14 and a blanket 90 on the sleeping bed 14 to direct the air onto a user 92 sleeping on the sleeping bed 14 thereby cooling the user 92. Each of the exhaust vents 88 has a bottom wall 94 and a forward side 96, and the forward side 96 of each of the exhaust vents 88 is open. Each of the exhaust vents 88 has a plurality of louvers 98 each is positioned therein to direct the flow of air through the exhaust vents 88. The bottom wall 94 of each of the exhaust vents 88 has an inlet port 100 extending therethrough. The inlet port 100 on the bottom wall 94 of each of the exhaust vents 88 fluidly engages the second end 50 of the respective hose 46.

A remote control 102 is provided that is in remote communication with the blower unit 12 for remotely controlling operation of the blower unit 12. The remote control 102 includes a transmitter 104 that is in wireless communication with the receiver 28 in the housing 18 of the blower unit 12. The transmitter 104 may be a radio frequency transmitter or the like. The remote control 102 includes a power button 106 that is movably coupled to the remote control 102 and the power button 106 on the remote control 102 is electrically coupled to the transmitter 104. The transmitter 104 broadcasts a power command to the receiver 28 and the control circuit 26 in the housing 18 receives the on input when the power button 106 on the remote control 102 is manipulated.

The remote control 102 includes a low button 108 that is movably coupled to the remote control 102 and the low button 108 is electrically coupled to the transmitter 104. The transmitter 104 broadcasts a low command to the receiver 28 when the low button 108 is depressed and the control circuit 26 receives the low input when the receiver 28 receives the low command. The remote control 102 includes a medium button 110 that is movably coupled to the remote control 102 and the medium button 110 is electrically coupled to the transmitter 104. The transmitter 104 broadcasts a medium command to the receiver 28 when the medium button 110 is depressed and the control circuit 26 receives the medium input when the receiver 28 receives the medium command. The remote control 102 includes a high button 112 that is movably coupled to the remote control 102 and the high button 112 is electrically coupled to the transmitter 104. The transmitter 104 broadcasts a high command to the receiver 28 when the high button 112 is depressed and the control circuit 26 receives the high input when the receiver 28 receives the high command.

The remote control 102 includes a plurality of time buttons 114 and each of the time buttons 114 is movably coupled to the remote control 102. Each of the time buttons 114 is associated with a respective duration of time ranging between a minimum duration of time and a maximum duration of time. The transmitter 104 broadcasts a time command to the receiver 28 when any of the time buttons 114 is depressed. Additionally, the electronic timer 32 counts down a duration of time that corresponds to which of the time buttons 114 is depressed.

In use, the blower unit 12 is positioned next to or beneath the sleeping bed 14 and the first panel 64 of each of the restraints 62 is slid between the box spring 58 and the mattress 60 of the sleeping bed 14. Each of the hoses 46 is attached to the clamps 82 on a respective restraint 62 and each of the exhaust vents 88 is positioned between the mattress 60 and the blanket 90 on the sleeping bed 14. In this way the exhaust vents 88 blow air onto the user 92 while the user 92 is lying under the blanket 90 thereby cooling the user 92 when the user 92 sleeps. As is most clearly shown in FIG. 2, a pair of the blower units 12 along with the attendant hoses 46 and exhaust vents 88 may be provided to cool the sleeping bed 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bed cooling assembly for blowing air between a mattress and a blanket for cooling a user while sleeping, said assembly comprising:

a blower unit being positionable adjacent to a bed for sleeping, said blower unit having a pair of outputs wherein said blower unit is configured to blow air outwardly through said outputs when said blower unit is turned on;

a pair of hoses, each of said hoses being fluidly coupled to a respective one of said outputs on said blower unit wherein each of said hoses is configured to direct the air blown by said blower;

a pair of restraints, each of said restraints being removably attachable to a respective one of said hoses, each of said restraints including a first panel being oriented to lie on a horizontal plane wherein said first panel of each of said restraints is configured to be inserted between a box spring and a mattress of the sleeping bed for mounting said respective hose to the sleeping bed, wherein each of said restraints comprises a second panel having a first surface and a second surface, a perimeter edge of said first panel being coupled to said second surface of said second panel spaced between a top edge of said second panel and a bottom edge of said second panel such that said first panel lies on a plane being oriented perpendicular to said second surface, said first panel having a top surface, said top surface of said first panel being textured wherein said first panel is configured to frictionally engage the mattress to retain said first panel between the mattress and the box spring, each of said restraints further comprising a pair of clamps coupled to said second panel of said restraint such that said pair of clamps are positioned on said first surface of said second panel with said first panel being positioned on said second surface between said pair of clamps;

a pair of exhaust vents, each of said exhaust vents being fluidly coupled to a respective one of said hoses wherein each of said exhaust vents is configured to receive the air from said blower unit, each of said exhaust vents being positionable between the sleeping bed and a blanket on the sleeping bed wherein each of said exhaust vents is configured to direct the air onto a user sleeping on the sleeping bed thereby cooling the user; and a remote control being in remote communication with said blower unit for remotely controlling operation of said blower unit.

2. The assembly according to claim 1, wherein said blower unit comprises a housing having a front wall and a top wall, each of said outputs extending through said top wall, said front wall having a pair of intakes each extending into an interior of said housing wherein each of said intakes is configured to pass air into said housing.

3. The assembly according to claim 2, wherein said blower unit comprises a control circuit being positioned in said housing, said control circuit receiving an on input, an off input, a low input, a medium input and a maximum input.

4. The assembly according to claim 3, wherein said blower unit comprises a receiver being positioned in said housing, said receiver being electrically coupled to said control circuit.

5. The assembly according to claim 3, wherein said blower unit includes a blower being positioned within said housing, said blower being in fluid communication between each of said intakes and each of said outlets wherein said blower is configured to urge air inwardly through each of said intakes and outwardly through each of said outlets when said blower is turned on, said blower being electrically coupled to said control circuit, said blower being turned on when said control circuit receives said on input, said blower being turned off when said blower receives said off input.

6. The assembly according to claim 5, wherein:

said blower is actuated to a minimum speed when said control circuit receives said low input wherein said blower is configured to blow a minimum volume of air;

said blower is actuated to a medium speed when said control circuit receives said medium input wherein said blower is configured to blow a medium volume of air; and said blower is actuated to a maximum speed when said control circuit receives said maximum input wherein said blower is configured to blow a maximum volume of air.

7. The assembly according to claim 3, wherein said blower unit includes an electronic timer being positioned within said housing, said electronic timer being electrically coupled to said control circuit, said electronic timer counting down a duration of time ranging between a minimum duration of time and a maximum duration of time, said control circuit receiving said off input when said electronic timer finishes counting time said duration of time.

8. The assembly according to claim 7, wherein said remote control includes:

a transmitter being in wireless communication with said receiver in said housing of said blower unit;

a power button being movably coupled to said remote control, said power button being electrically coupled to said transmitter, said transmitter broadcasting a power command to said receiver, said control circuit in said housing receiving said on input when said power button on said remote control is manipulated;

a low button being movably coupled to said remote control, said low button being electrically coupled to said transmitter, said transmitter broadcasting a low command to said receiver, said control circuit receiving said low input when said receiver receives said low command;

a medium button being movably coupled to said remote control, said medium button being electrically coupled to said transmitter, said transmitter broadcasting a medium command to said receiver, said control circuit receiving said medium input when said receiver receives said medium command;

a high button being movably coupled to said remote control, said high button being electrically coupled to said transmitter, said transmitter broadcasting a high command to said receiver, said control circuit receiving said high input when said receiver receives said high command; and a plurality of time buttons, each of said time buttons being movably coupled to said remote control, each of said time buttons being associated with a respective duration of time ranging between a minimum duration of time and a maximum duration of time, said transmitter broadcasting a time command to said receiver when any of said time buttons is depressed, said electronic timer counting down a duration of time that corresponds to which of said time buttons is depressed.

9. The assembly according to claim 3, wherein said blower unit includes a plurality of light emitters, each of said light emitters being coupled to said front wall of said housing wherein each of said light emitters is configured to emit light outwardly therefrom, each of said light emitters being electrically coupled to said control circuit, a respective one of said light emitters being actuated when said control circuit receives said low input, said medium input or said maximum input.

10. The assembly according to claim 3, wherein said blower unit includes a power button being movably coupled to said front wall of said housing wherein said power button is configured to be manipulated by a user, said power button being electrically coupled to said control circuit for turning said control circuit on and off.

11. The assembly according to claim 3, wherein said blower unit includes a power cord being coupled to and extending away from said housing, said power cord being electrically coupled to said control circuit, said power cord having a distal end with respect to said housing, said distal end having a male plug being electrically coupled thereto wherein said male plug is configured to be plugged into a power source comprising a female electrical outlet.

12. The assembly according to claim 2, wherein each of said hoses has a first end, a second end and an outer surface extending therebetween, said first end of each of said hoses being fluidly coupled to outlets on said top wall of said housing, said outer surface of each of said hoses having a rigid portion extending from said second end toward said first end, said rigid portion being comprised of a rigid material thereby inhibiting said rigid portion from flexing wherein said rigid portion is configured to extend upwardly along a front end of the box spring and the mattress of the sleeping bed, said rigid portion being textured.

13. The assembly according to claim 12, wherein each of said exhaust vents has a bottom wall and a forward side, said forward side of each of said exhaust vents being open, each of said exhaust vents having a plurality of louvers each being positioned therein wherein said louvers are configured to direct the flow of air through said exhaust vents, said bottom wall of each of said exhaust vents having an inlet port extending therethrough, said inlet port on said bottom wall of each of said exhaust ports fluidly engaging said second end of said respective hose.

14. The assembly according to claim 1, wherein each of said restraints includes a pair of shock absorbers, each of said shock absorbers having a first portion being spaced from a second portion, said second portion of a respective shock absorber being biased away from said first portion of said respective shock absorber, said second portion of a respective shock absorber being compressible toward said first portion of said respective shock absorber, said first portion of each of said shock absorbers being coupled to said first surface of said second panel, said shock absorbers being spaced apart from each other and being distributed along said second panel.

15. The assembly according to claim 14, wherein:

each of said hoses has a first end, a second end and an outer surface extending therebetween, said outer surface of each of said hoses having a rigid portion extending from said second end toward said first end; and each of said restraints comprises said pair of clamps, each of said clamps being coupled to said second portion of a respective one of said shock absorbers, each of said clamps having a primary end and a secondary end, each of said clamps being curved between said primary end and said secondary end such that each of said clamps has a C-shape thereby facilitating each of said clamps to releasably engage said rigid portion of a respective one of said hoses thereby attaching said respective hose to said second panel.

16. A bed cooling assembly for blowing air between a mattress and a blanket for cooling a user while sleeping, said assembly comprising:

a blower unit being positionable adjacent to a bed for sleeping, said blower unit having a pair of outputs wherein said blower unit is configured to blow air outwardly through said outputs when said blower unit is turned on, said blower unit comprising:

a housing having a front wall and a top wall, each of said outputs extending through said top wall, said front wall having a pair of intakes each extending into an interior of said housing wherein each of said intakes is configured to pass air into said housing;

a control circuit being positioned in said housing, said control circuit receiving an on input, an off input, a low input, a medium input and a maximum input;

a receiver being positioned in said housing, said receiver being electrically coupled to said control circuit;

a blower being positioned within said housing, said blower being in fluid communication between each of said intakes and each of said outlets wherein said blower is configured to urge air inwardly through each of said intakes and outwardly through each of said outlets when said blower is turned on, said blower being electrically coupled to said control circuit, said blower being turned on when said control circuit receives said on input, said blower being turned off when said blower receives said off input, said blower being actuated to a minimum speed when said control circuit receives said low input wherein said blower is configured to blow a minimum volume of air, said blower being actuated to a medium speed when said control circuit receives said medium input wherein said blower is configured to blow a medium volume of air, said blower being actuated to a maximum speed when said control circuit receives said maximum input wherein said blower is configured to blow a maximum volume of air;

an electronic timer being positioned within said housing, said electronic timer being electrically coupled to said control circuit, said electronic timer counting down a duration of time ranging between a minimum duration of time and a maximum duration of time, said control circuit receiving said off input when said electronic timer finishes counting time said duration of time;

a plurality of light emitters, each of said light emitters being coupled to said front wall of said housing wherein each of said light emitters is configured to emit light outwardly therefrom, each of said light emitters being electrically coupled to said control circuit, a respective one of said light emitters being actuated when said control circuit receives said low input, said medium input or said maximum input;

a power button being movably coupled to said front wall of said housing wherein said power button is configured to be manipulated by a user, said power button being electrically coupled to said control circuit for turning said control circuit on and off; and a power cord being coupled to and extending away from said housing, said power cord being electrically coupled to said control circuit, said power cord having a distal end with respect to said housing, said distal end having a male plug being electrically coupled thereto wherein said male plug is configured to be plugged into a power source comprising a female electrical outlet;

a pair of hoses, each of said hoses being fluidly coupled to a respective one of said outputs on said blower unit wherein each of said hoses is configured to direct the air blown by said blower, each of said hoses having a first end, a second end and an outer surface extending therebetween, said first end of each of said hoses being fluidly coupled to outlets on said top wall of said housing, said outer surface of each of said hoses having a rigid portion extending from said second end toward said first end, said rigid portion being comprised of a rigid material thereby inhibiting said rigid portion from flexing wherein said rigid portion is configured to extend upwardly along a front end of a box spring and a mattress of the sleeping bed, said rigid portion being textured;

a pair of restraints, each of said restraints being removably attachable to a respective one of said hoses, each of said restraints including a first panel being oriented to lie on a horizontal plane wherein said first panel of each of said restraints is configured to be inserted between the box spring and the mattress of the sleeping bed for mounting said respective hose to the sleeping bed, each of said restraints comprising:

a second panel having a first surface and a second surface, said second surface of said second panel having a perimeter edge of said first panel being coupled thereto such that said first panel lies on a plane being oriented perpendicular to said second surface, said first panel having a top surface, said top surface of said first panel being textured wherein said first panel is configured to frictionally engage the mattress to retain said first panel between the mattress and the box spring;

a pair of shock absorbers, each of said shock absorbers having a first portion being spaced from a second portion, said second portion of a respective shock absorber being biased away from said first portion of said respective shock absorber, said second portion of a respective shock absorber being compressible toward said first portion of said respective shock absorber, said first portion of each of said shock absorbers being coupled to said first surface of said second panel, said shock absorbers being spaced apart from each other and being distributed along said second panel; and a pair of clamps, said pair of clamps being coupled to said second panel of said restraint such that said pair of clamps are positioned on said first surface of said second panel with said first panel being positioned on said second surface between said pair of clamps, each of said clamps being coupled to said second portion of a respective one of said shock absorbers, each of said clamps having a primary end and a secondary end, each of said clamps being curved between said primary end and said secondary end such that each of said clamps has a C-shape thereby facilitating each of said clamps to releasably engage said rigid portion of a respective one of said hoses thereby attaching said respective hose to said second panel; and a pair of exhaust vents, each of said exhaust vents being fluidly coupled to a respective one of said hoses wherein each of said exhaust vents is configured to receive the air from said blower unit, each of said exhaust vents being positionable between the sleeping bed and a blanket on the sleeping bed wherein each of said exhaust vents is configured to direct the air onto a user sleeping on the sleeping bed thereby cooling the user, each of said exhaust vents having a bottom wall and a forward side, said forward side of each of said exhaust vents being open, each of said exhaust vents having a plurality of louvers each being positioned therein wherein said louvers are configured to direct the flow of air through said exhaust vents, said bottom wall of each of said exhaust vents having an inlet port extending therethrough, said inlet port on said bottom wall of each of said exhaust ports fluidly engaging said second end of said respective hose; and a remote control being in remote communication with said blower unit for remotely controlling operation of said blower unit, said remote control including:

a transmitter being in wireless communication with said receiver in said housing of said blower unit;

a power button being movably coupled to said remote control, said power button being electrically coupled to said transmitter, said transmitter broadcasting a power command to said receiver, said control circuit in said housing receiving said on input when said power button on said remote control is manipulated;

a low button being movably coupled to said remote control, said low button being electrically coupled to said transmitter, said transmitter broadcasting a low command to said receiver, said control circuit receiving said low input when said receiver receives said low command;

a medium button being movably coupled to said remote control, said medium button being electrically coupled to said transmitter, said transmitter broadcasting a medium command to said receiver, said control circuit receiving said medium input when said receiver receives said medium command;

a high button being movably coupled to said remote control, said high button being electrically coupled to said transmitter, said transmitter broadcasting a high command to said receiver, said control circuit receiving said high input when said receiver receives said high command; and a plurality of time buttons, each of said time buttons being movably coupled to said remote control, each of said time buttons being associated with a respective duration of time ranging between a minimum duration of time and a maximum duration of time, said transmitter broadcasting a time command to said receiver when any of said time buttons is depressed, said electronic timer counting down a duration of time that corresponds to which of said time buttons is depressed.

* * * * *